US007043772B2

(12) United States Patent
Bielefeld et al.

(10) Patent No.: US 7,043,772 B2
(45) Date of Patent: May 16, 2006

(54) RATCHET MECHANISM WITH UNITARY KNOB AND PINION CONSTRUCTION

(75) Inventors: Eric Bielefeld, Lexington, KY (US); Mark Ferguson, Cynthiana, KY (US)

(73) Assignee: E. D. Bullard Company, Cynthiana, KY (US)

( * ) Notice: Subject to any disclaimer, the term of this patent is extended or adjusted under 35 U.S.C. 154(b) by 44 days.

(21) Appl. No.: 10/930,633

(22) Filed: Aug. 31, 2004

(65) Prior Publication Data

US 2006/0048285 A1 Mar. 9, 2006

(51) Int. Cl.
*A42B 1/22* (2006.01)

(52) U.S. Cl. ..... 2/418; 2/DIG. 11

(58) Field of Classification Search ..... 2/417, 2/418, 419, 420, 416, 183, DIG. 11, 8; 132/59; 24/68 B, 274 WB, 664, 578.15
See application file for complete search history.

(56) References Cited

U.S. PATENT DOCUMENTS 2,511,234 A * 6/1950 Anderson ..... 2/8
3,041,622 A * 7/1962 Gurtowski ..... 2/8
3,214,809 A * 11/1965 Edwards ..... 24/68 B
3,444,560 A * 5/1969 Northup, Jr. ..... 2/8
4,942,628 A * 7/1990 Freund ..... 2/416
5,950,245 A 9/1999 Binduga
6,481,019 B1 * 11/2002 Diaz et al. ..... 2/171.3
6,609,254 B1 * 8/2003 Bielefeld et al. ..... 2/416

* cited by examiner

*Primary Examiner*—Rodney M. Lindsey
(74) *Attorney, Agent, or Firm*—Stites & Harbison, PLLC; David W. Nagle, Jr.

(57) ABSTRACT

A ratchet mechanism for the headband of a protective helmet or other headgear minimizes the number of components while ensuring precise, reliable operation of the rack and pinion arrangement of the ratchet mechanism. A headband of a protective helmet or similar headgear generally has overlapping rear end portions which are enclosed in a housing. The ratchet mechanism includes a rotational element, which in this case is a unitary body that includes an adjustment knob portion which is positioned on an exterior side of the outer housing section and a pinion portion which is positioned on an interior side of the outer housing section is adapted to mate with and engage the respective rack gears of the overlapping rear end portions of the headband.

10 Claims, 8 Drawing Sheets

RATCHET MECHANISM WITH UNITARY KNOB AND PINION CONSTRUCTION

BACKGROUND OF THE INVENTION

The present invention relates to a ratchet mechanism for the headband of a protective helmet or similar headgear, a mechanism that allows for adjustment of the size and fit of the headband.

Protective helmets are commonly worn in the industrial workplace to prevent or reduce the likelihood of head injuries. The hard hat is the most common and well-recognized protective helmet. A hard hat consists of three primary components—a shell, a headband, and a suspension system—which cooperate to reduce the potential for injury by attenuating some translational energy of the force of an impact to the helmet.

With respect to the construction and protection afforded by a hard hat, the American National Standards Institute ("ANSI") promulgates minimum performance requirements for protective helmets and further classifies helmets based on their ability to reduce the forces of impact and penetration, as well as their ability to protect against high voltage electric shock. See, for example, ANSI Z89.1-1997 (R1998), American National Standard for Industrial Head Protection.

As mentioned above, a hard hat or similar protective helmet is comprised primarily of: a shell, a headband, and a suspension system. These primary hard hat components cooperate to provide the requisite level of protection. The hard hat shell itself causes any force of impact to be spread across the surface area of the shell. The hard hat suspension separates the wearer's head from the shell such that there is an air gap between the shell and the wearer's head that provides for further attenuation of the force of an impact to the shell. Specifically, when an object strikes the shell of the hard hat, the shell itself flexes inward and the straps of the suspension system will stretch. The air gap accommodates the flexing of the shell and stretching of the straps, but, under normal conditions, prevents the wearer's head from contacting the hard hat shell.

Of course, for a hard hat to provide the appropriate level of protection, it must fit snugly on the wearer's head. In this regard, it is common for the headband of a hard hat to be adjustable to provide for such a snug fit. In this regard, a headband typically has one of two common sizing mechanisms, a pin-lock arrangement or a ratchet mechanism. Regardless of the chosen sizing mechanism, the headband is commonly a flexible, one-piece member that has overlapping rear end portions. With a pin-lock mechanism, a first of the rear end portions of the headband is provided with a pin, and the second of the rear end portions is provided with series of holes at spaced intervals. As such, the pin of the first rear end portion can be inserted through one of the holes of the second rear end portion, thus forming a loop of a selected circumference to fit snugly around the wearer's head. With a ratchet mechanism, lateral movement of the overlapping rear end portions of the headband is effectuated through a rack and pinion arrangement or similar gear arrangement.

As one example of a ratchet mechanism, reference is made to U.S. Pat. No. 4,888,831 issued to Oleson, a patent that is incorporated herein by this reference. As described in the '831 Patent, a preferred ratchet mechanism is often a rack and pinion arrangement which operates within elongated overlapping slots defined by the rear end portions of the headband, each of said slots defining a series of teeth of a rack gear. The rack and pinion arrangement and the overlapping rear end portions of the headband are housed between a pair of adjoining arc-shaped housing sections which generally conform to the contour of the wearer's head. The rear end portions of the headband are seated for slidable, lateral movement within the arc-shaped housing sections.

Referring still to the '831 Patent, and specifically FIG. 3, one preferred rack and pinion arrangement includes five components: (1) an adjusting knob; (2) a first sprocket that is operably secured to the adjusting knob and engages mating gear teeth defined by the outer housing section, the rearward facing of the two housing sections that enclose the headband; (3) a second sprocket that is operably secured to the first sprocket and engages the teeth of the rack gears of the overlapping rear end portions of the headband; (4) a plate or washer interposed between the first and second sprockets; and (5) a spring or similar biasing member interposed between the first sprocket and the plate so as to bias the first sprocket into engagement with the mating gear teeth defined by the outer housing section. The adjusting knob, first sprocket, and the second sprocket all turn together, with clockwise rotation of the adjusting knob tightening the headband, and counterclockwise rotation of the adjusting knob loosening the headband. The interposed plate and spring bias the first sprocket into engagement with the mating gear teeth defined by the outer housing section so that the rear end portions of the headband do not slide or move without appropriate action by the wearer. In other words, since the interposed plate and spring bias the first sprocket into engagement with the mating gear teeth defined by the outer housing section, the position of the rear end portions of the headband is locked absent manipulation of the adjustment knob by the wearer.

For another example of a rack and pinion arrangement, reference is made to U.S. Pat. No. 5,950,245 issued to Binduga. Again, the headband has overlapping rear end portions. Elongated slots are defined by the rear end portions of the headband, with each of said slots defining a series of teeth of a rack gear. As described in the '245 Patent with reference to FIGS. 1 and 2, the rack and pinion arrangement preferably includes (1) an adjustment knob with a first end section for providing a grip member suitable for gripping and turning by the wearer and a second end section that is a generally circular cog, the circular cog engaging the teeth of the rack gears defined by the overlapping rear end portions of the headband; (2) a spring assembly integral with or otherwise secured to the adjustment knob; (3) a housing having outer and inner arc-shaped sections that collectively define an internal cavity; and (4) a ring gear assembly fixed within the housing that cooperates with the spring assembly to provide resistance to rotation of adjustment knob. Thus, in practice, rotation of the adjustment knob causes lateral movement of the overlapping rear end portions of the headband relative to one another. However, because the spring assembly has at least one spring tooth projecting radially and adapted for mating with radially projecting teeth of the ring gear assembly, the position of the rear end portions of the headband is essentially locked absent manipulation of the adjustment knob by the wearer.

For yet another example of a rack and pinion arrangement, reference is made to U.S. patent application Ser. No. 10/899,467, which is also incorporated herein by reference. Again, the rack and pinion arrangement and the overlapping rear end portions of the headband are housed between a pair of adjoining arc-shaped housing sections which generally conform to the contour of the wearer's head. The rear end portions of the headband are seated for slidable, lateral movement within the arc-shaped housing sections, again in response to the rotation of an adjustment knob. Furthermore, as described in U.S. patent application Ser. No. 10/899,467, the arc-shaped housing sections have an inherent flexibility that provides for better fit of the headband and increased comfort to the wearer.

However, the rack and pinion arrangements described in the prior art are generally comprised of a number of individual parts, requiring labor-intensive assembly and also increasing the risk of imprecise or flawed operation of the rack and pinion arrangement. For example, the adjustment knob and pinion (also referred to as a sprocket or cog in some of the prior art references) are often separate parts that are assembled together after the shaft of the adjustment knob is passed through the outer housing section. Alternatively, as described in the above-referenced '245 Patent, if the adjustment knob and pinion are a unitary part, the outer housing section must be comprised of multiple parts to allow assembly of the components of the rack and pinion arrangement It would therefore be desirable to provide an improved construction for a ratchet mechanism for the headband of a protective helmet or other headgear so as to minimize the number of components and ensure precise, reliable operation of the rack and pinion arrangement of the ratchet mechanism.

SUMMARY OF THE INVENTION

The present invention is a ratchet mechanism for the headband of a protective helmet or other headgear that minimizes the number of components while ensuring precise, reliable operation of the rack and pinion arrangement of the ratchet mechanism.

The headband of a protective helmet or similar headgear generally has overlapping rear end portions which are enclosed in a housing, which is preferably comprised of an outer substantially arc-shaped housing section joined to a inner substantially arc-shaped housing section, thus defining an internal cavity for receiving the overlapping rear end portions of the headband. Of particular importance to the present invention, the ratchet mechanism also includes a rotational element, which in this case is a unitary body that includes an adjustment knob portion which is positioned on an exterior side of the outer housing section, and a pinion portion which is positioned on an interior side of the outer housing section and within the internal cavity defined by the housing. This rotational element therefore may be characterized as having a unitary construction. In any event, the pinion is adapted to mate with and engage the respective rack gears of the overlapping rear end portions of the headband such that rotation of the pinion causes lateral movement of the overlapping rear end portions with respect to one another.

Furthermore, the outer housing section of the ratchet mechanism is also a unitary body in that it is not comprised of multiple discrete components. Because of this unitary construction of the rotational element and the unitary nature of the outer housing section, these two components can not be joined or assembled to one another in a traditional sense. Rather, these components must be manufactured substantially simultaneously, with the rotational element essentially being molded around the outer housing section.

Therefore, as a result of the unitary knob and pinion construction, assembly of the ratchet mechanism is significantly simplified, and there are no small parts that require tedious and time-consuming assembly efforts. Furthermore, through the molding process, dimensional tolerances can be tightly controlled, leading to improved reliability and performance.

DESCRIPTION OF THE INVENTION

The present invention is a ratchet mechanism for the headband of a protective helmet or other headgear that minimizes the number of components while ensuring precise, reliable operation of the rack and pinion arrangement of the ratchet mechanism.

Figure 1:
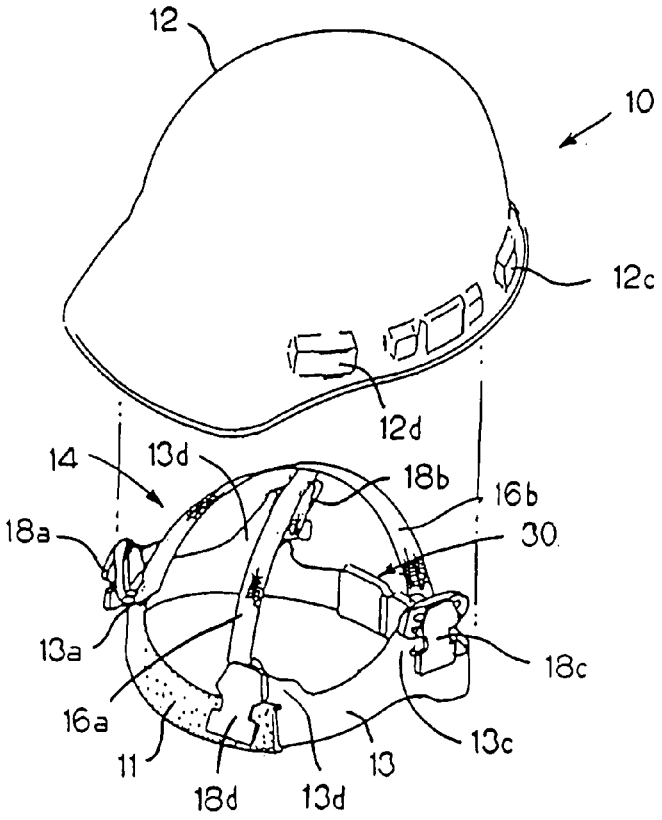
FIG. 1 is an exploded perspective view of a hard hat having an exemplary ratchet mechanism made in accordance with the present invention.

FIG. 1 is an exploded perspective view of an exemplary hard hat 10 that includes a ratchet mechanism made in accordance with the present invention. As shown, this hard hat 10 generally includes: a substantially rigid shell 12 shaped to protect the wearer's head, said shell 12 defining a bottom opening and an internal cavity for receiving the wearer's head; a headband 13 with an absorbent brow pad 11; and a suspension 14. In this exemplary embodiment, the hard hat 10 has a 4-point suspension 14 comprising two intersecting straps 16*a*, 16*b*. A key 18*a*, 18*b*, 18*c*, 18*d* is secured to each end of each of the straps 16*a*, 16*b*. Thus, to secure the suspension 14 to the shell 12 of the hard hat 10, the shell 12 includes four key sockets spaced about the periphery of the shell 12, each such key socket being molded into the shell 12 and adapted to receive one of the keys (generally and collectively indicated by reference numeral 18). In this regard, key sockets 12*c* and 12*d* are illustrated and labeled in FIG. 1. It is contemplated and preferred that the keys 18 be constructed such that they can be "locked" into the key sockets. For further detail regarding one preferred construction of the keys 18 and associated key sockets, reference is made to U.S. Pat. No. 6,609,254, which is incorporated herein by reference.

Figure 2:
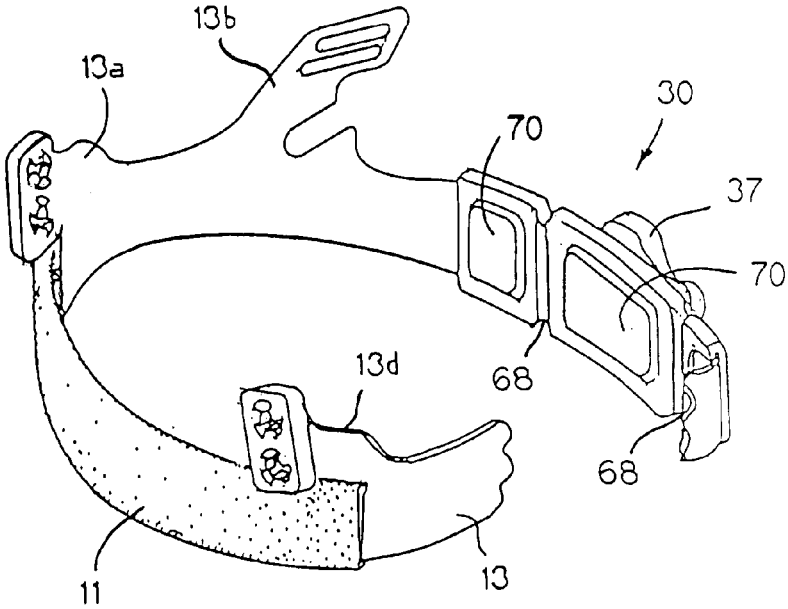
FIG. 2 is an enlarged perspective view of a portion of the headband and associated ratchet mechanism of the hard hat of FIG. 1.

As shown in FIGS. 1 and 2, the headband 13 has a plurality of upwardly extending appendages 13*a*, 13*b*, 13*c*, 13*d*. Each such appendage 13*a*, 13*b*, 13*c*, 13*d* corresponds with a respective key 18*a*, 18*b*, 18*c*, 18*d* of the suspension 14, such that the keys 18 can be secured to the headband 13, completing assembly of the essential components of the hard hat 10.

Nevertheless, the attachment of the headband 13 and suspension straps 16*a*, 16*b* to the shell 12 of the hard hat 10 is not the focus of the present application. Indeed, it is recognized that various attachment means could be employed without departing from the spirit and scope of the present invention. Rather, the present invention relates to a ratchet mechanism for the headband 13 of a hard hat 10 or other protective headgear, as generally indicated by reference numeral 30 in FIGS. 1 and 2.

Figure 3:
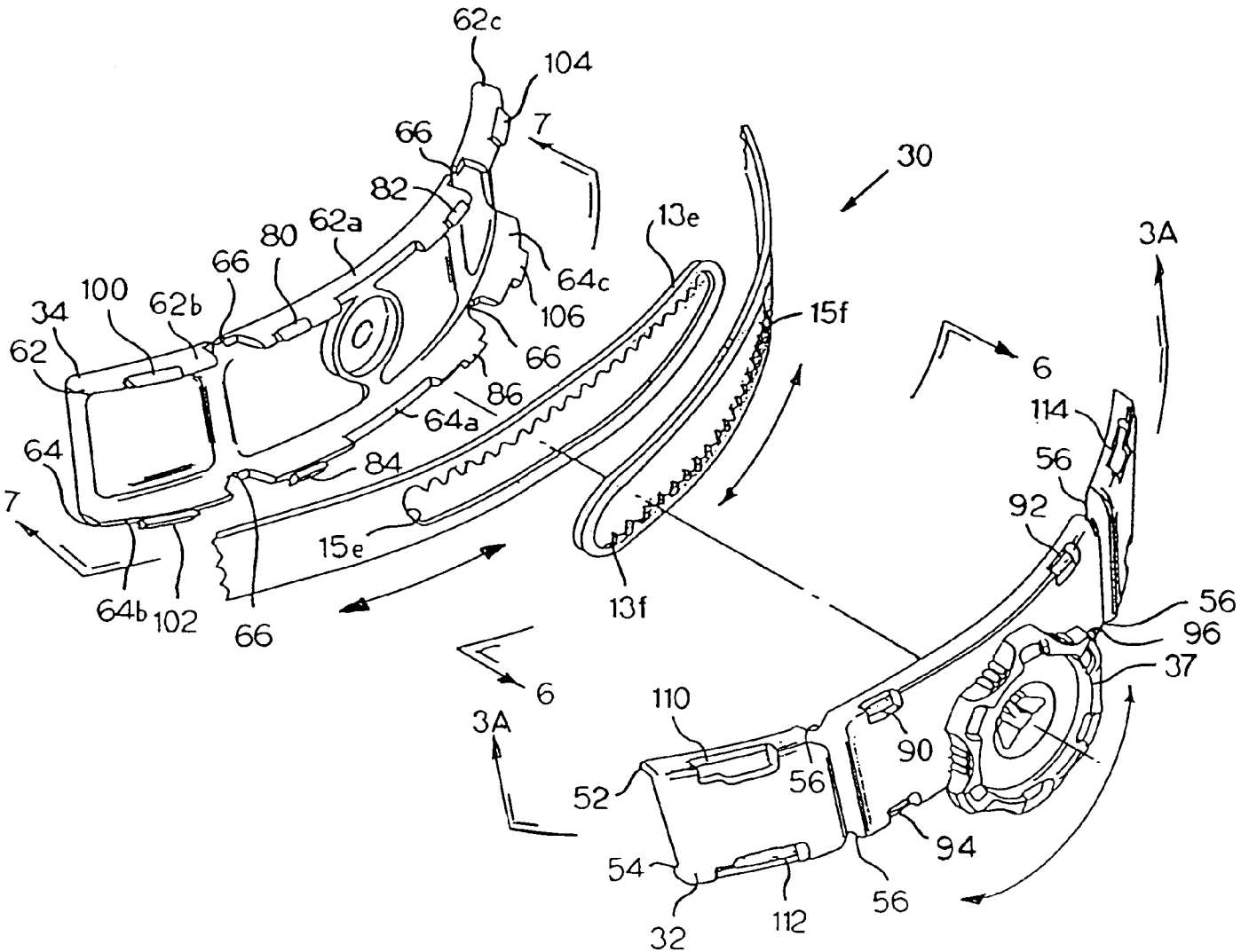
FIG. 3 is an exploded perspective view of the exemplary ratchet mechanism of the hard hat of FIG. 1.

Referring now to FIG. 3, the preferred components of a ratchet mechanism 30 made in accordance with the present invention are illustrated. First, the headband 13 itself has overlapping rear end portions 13*e*, 13*f*. Each of these portions 13*e*, 13*f* preferably defines an elongated slot 15*e*, 15*f* and associated rack gear, the rack gear of one portion 13*e* defined along the upper edge of the slot 15*e*, and the rack gear of the second portion 13*f* defined along the lower edge of the slot 15*f*.

The overlapping rear end portions 13*e*, 13*f* are enclosed in a housing, which is preferably comprised of an outer substantially arc-shaped housing section 32 joined to an inner substantially arc-shaped housing section 34, thus defining an internal cavity for receiving the overlapping rear end portions 13*e*, 13*f* of the headband 13. Each of these housing sections 32, 34 is preferably made of polypropylene or a similar plastic material. Of particular importance to the present invention, the ratchet mechanism 30 also includes a rotational element 36, which in this case is a unitary body that includes an adjustment knob portion 37 which is positioned on an exterior side of the outer housing section 32, and a pinion portion 38 which is positioned on an interior side of the outer housing section 32 and within the internal cavity defined by the housing. This rotational element 36 therefore may be characterized as having a unitary construction, the details of which are further described below.

In any event, the pinion 38 is adapted to mate with and engage the respective rack gears of the overlapping rear end portions 13*e*, 13*f* of the headband 13 such that rotation of the pinion 38 causes lateral movement of the overlapping rear end portions 13*e*, 13*f* with respect to one another.

Figure 4:
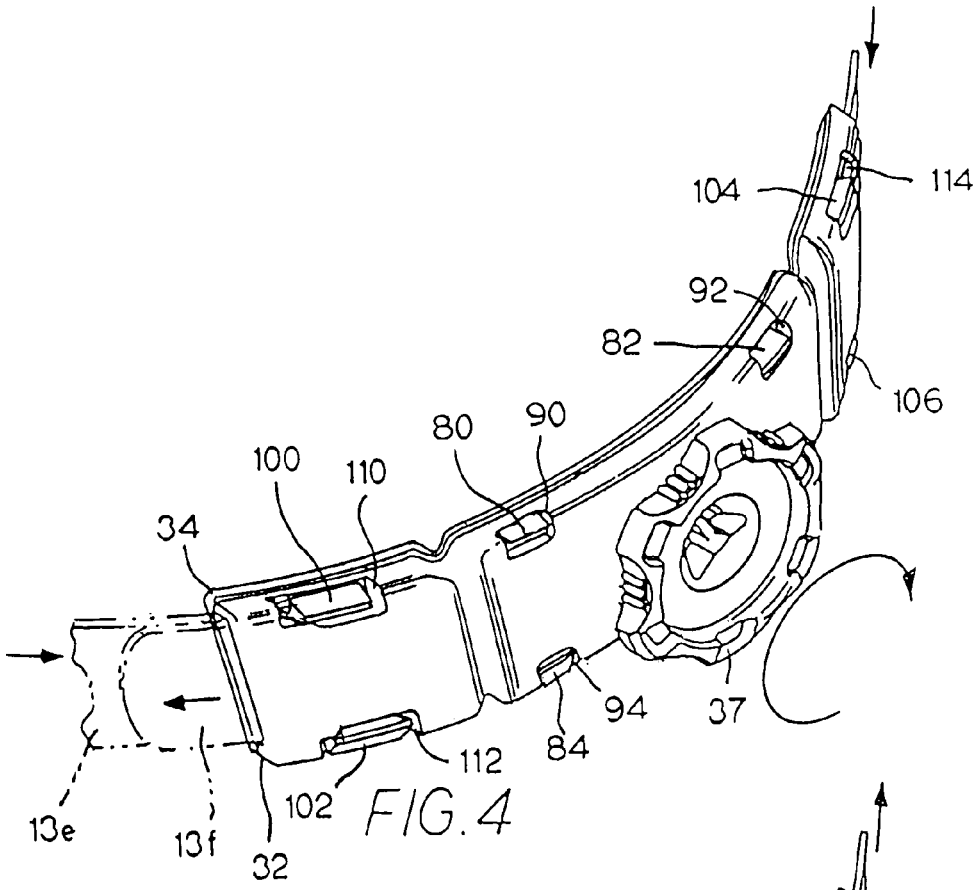
FIG. 4 is a perspective view of the exemplary ratchet mechanism of FIG. 1, illustrating movement of the rear end portions of the headband caused by clockwise rotation of an adjustment knob.
Figure 5:
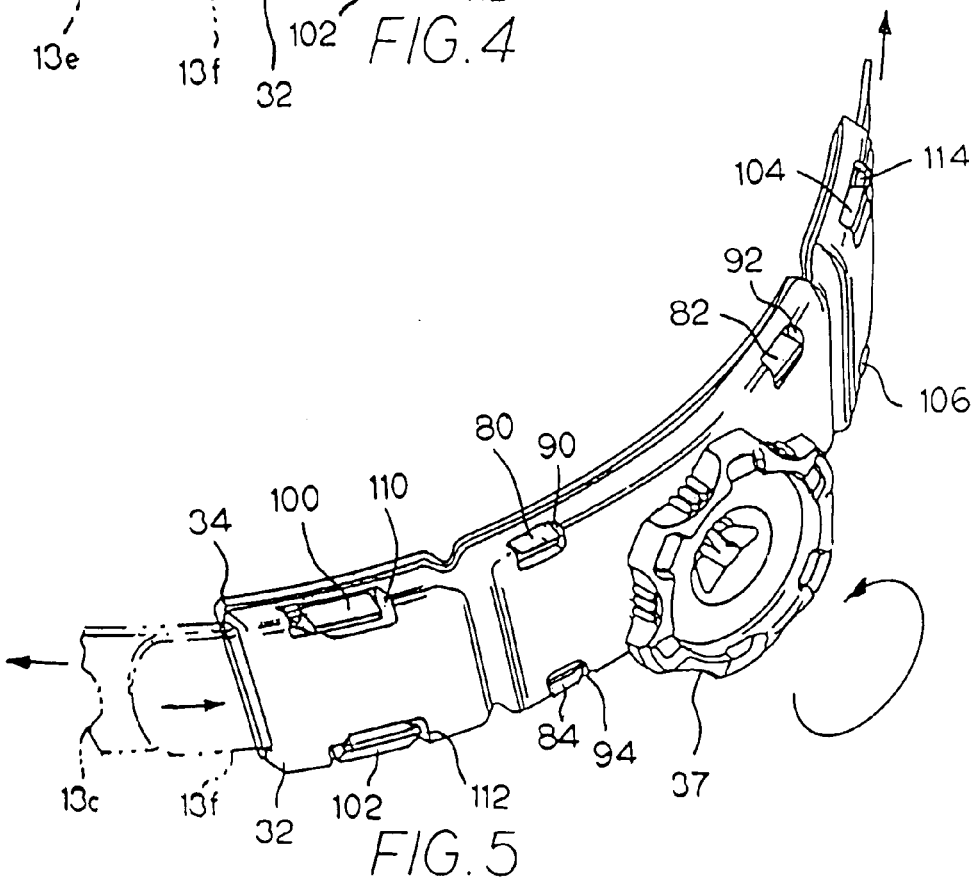
FIG. 5 is a perspective view of the exemplary ratchet mechanism of FIG. 1, illustrating movement of the rear end portions of the headband caused by counterclockwise rotation of the adjustment knob.
Figure 6:
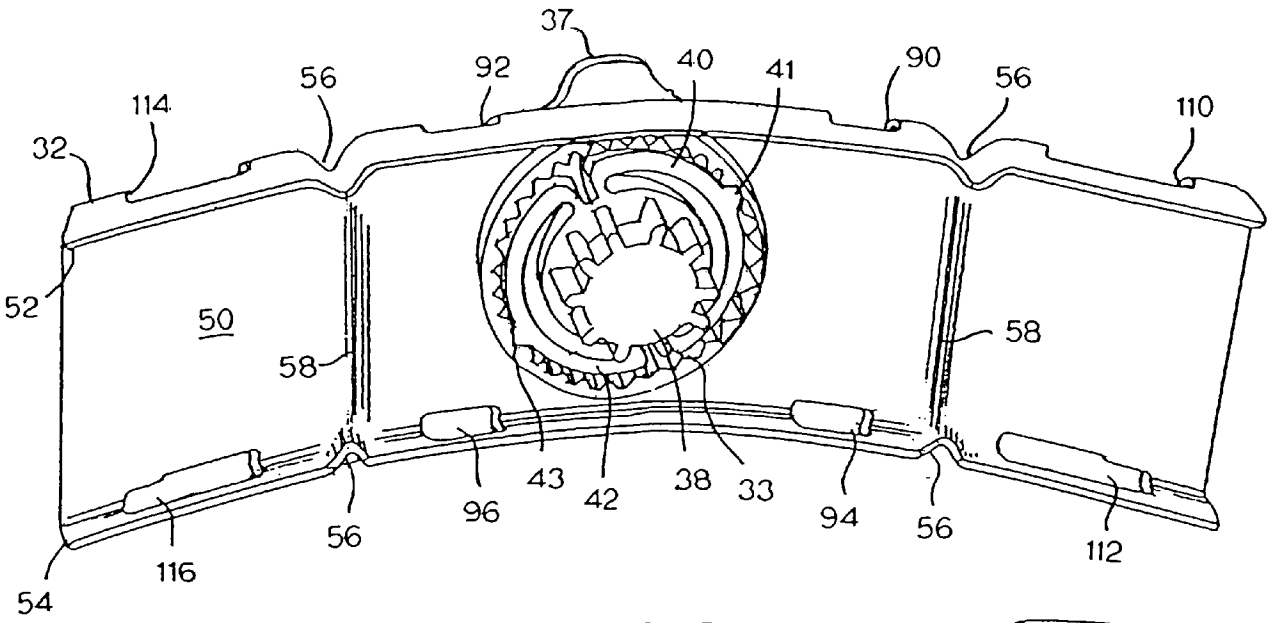
FIG. 6 is a perspective view of the outer housing section of the exemplary ratchet mechanism of FIG. 1 taken along line 6—6 of FIG. 3, with the rotational element received in the ring gear.
Figure 6A:
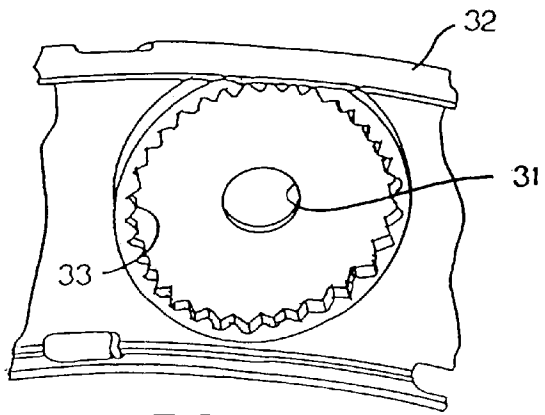
FIG. 6A is a perspective view of the outer housing section of the exemplary ratchet mechanism of FIG. 1, similar to the view of FIG. 6, but with the rotational element removed to better illustrate the ring gear.

Furthermore, similar to prior art constructions, the rotational element 36 is further provided with an integral spring assembly, which, in this exemplary embodiment, is comprised of two substantially semi-circular arch portions 40, 42 disposed on opposite sides of the central axis of rotation of the rotational element 36. A spring tooth 41, 43 extends from each of the arch portions 40, 42. As best shown in FIGS. 6 and 6A, the outer housing section 32 defines a ring gear 33 that circumscribes an opening 31 through which a shaft portion 39 of the rotational element 36 passes. Thus, the respective spring teeth 41, 43 extending from each of the arch portions 40, 42 of the spring assembly mate with and engage the teeth of the ring gear 33, locking the position of the rotational element 36, and thus the rear end portions 13*e*, 13*f* of the headband 13 relative the outer housing section 32. However, when the adjustment knob 37 of the rotational element 36 is manually turned by a wearer, the spring teeth 41, 43 are forced over the teeth of the ring gear 33 by radially inward compression of the arch portions 40, 42 of the spring assembly. In other words, by imparting a sufficient torque on the rotational element 36, the wearer can overcome the spring force and effectuate lateral movement of the overlapping rear end portions 13*e*, 13*f* of the headband 13 relative to one another. As shown in FIG. 4, clockwise rotation of the adjustment knob 37 moves the rear end portions 13*e*, 13*f* of the headband toward one another, decreasing the circumference of the headband 13. On the other hand, as shown in FIG. 5, counterclockwise rotation of the adjustment knob 37 moves the rear end portions 13*e*, 13*f* of the headband away one another, increasing the circumference of the headband 13. Once the wearer ceases rotation of the adjustment knob 37, the spring teeth 41, 43 are restored to engagement with the teeth of the ring gear 33, again locking the position of the rear end portions 13*e*, 13*f* of the headband 13.

Figure 3A:
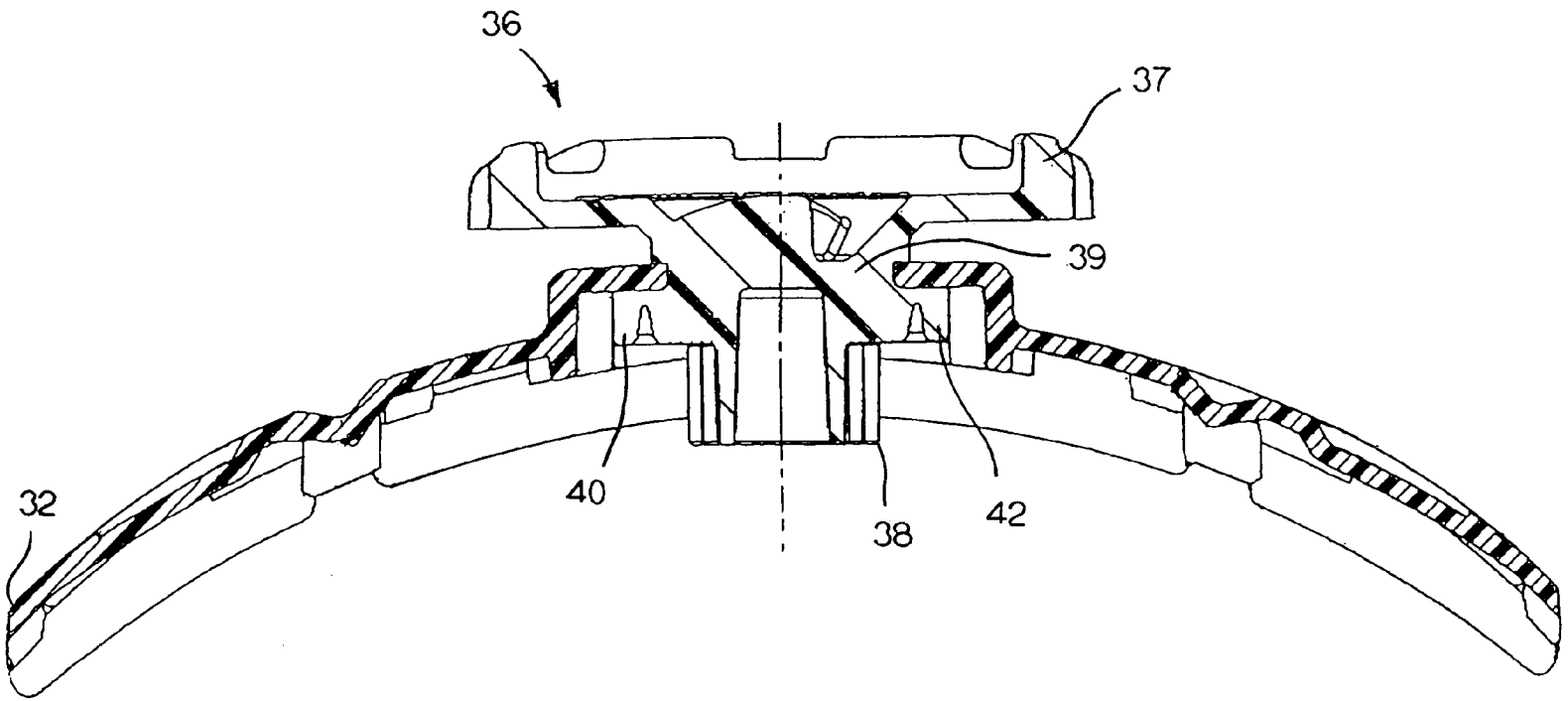
FIG. 3A is a sectional view of a portion of the exemplary ratchet mechanism of FIG. 1 taken along line 3A—3A of FIG. 3.

Returning to the construction of the rotational element 36, reference is now made to the sectional view of FIG. 3A. Again, the rotational element 36 is a unitary body that includes an adjustment knob portion 37 which is positioned on an exterior side of the outer housing section 32, and a pinion portion 38 which is positioned on an interior side of the outer housing section 32 and within the internal cavity defined by the housing. Furthermore, this unitary body includes the above-referenced integral spring assembly, which, in this exemplary embodiment, is comprised of two substantially semi-circular arch portions 40, 42 with a spring tooth 41, 43 extending from each of the arch portions 40, 42.

As shown in FIG. 3A, the outer housing section 32 of the ratchet mechanism 30 is also a unitary body in that it is not comprised of multiple discrete components, with the ring gear 33 mentioned above being molded into and integral with the outer housing section 32. Because of this unitary construction of the rotational element 36 and the unitary nature of the outer housing section 32, these two components can not be joined or assembled to one another in a traditional sense. Rather, these components must be manufactured substantially simultaneously, with the rotational element 36 essentially being molded around the outer housing section 32. In other words, the rotational element 36 is molded through the opening 31 defined by the outer housing section 32, with the adjustment knob portion 37 and the pinion portion 38 positioned on opposite sides of the outer housing section 32.

This molding process is generally accomplished using a two-shot molding in which a plastic, such as polypropylene, for forming the outer housing section 32, including the integral ring gear 33, is first injected into a mold cavity (i.e., the "first shot"). Once the preform is adequately cooled, a second plastic, such as a thermal plastic elastomer (TPE), is injected into the mold cavity for forming the rotational element 36 around the outer housing section 32 (i.e., the "second shot"). Specifically, one preferred means by which to accomplish this two-shot molding is by using a rotary method with an index plate in which the first shot produces a preform, which is then rotated 180° by the index plate to a second injection position where the second shot is used to complete the molding. For example, one preferred mold press for accomplishing the molding required by the present invention is the Van Dom Multi™ mold press, which is manufactured and distributed by the Demag Plastics Group Corp. of Strongsville, Ohio, and allows for an L-position second injection unit to inject the second shot from the offside of the press. Furthermore, with respect to the plastics used in the molding process, various plastic materials may be used without departing from the spirit and scope of the present invention, with the understanding that different plastics must be used for the outer housing section 32 and the rotational element 36, so that they will not become bonded together during the molding process.

As a result of the unitary knob and pinion construction, assembly of the ratchet mechanism 30 is significantly simplified, requiring only positioning of the rear end portions 13*e*, 13*f* of the headband 13 in engagement with the pinion portion 38 of the rotational element 36 before securing the inner housing section 34 to the outer housing section 32. There are no small parts that require tedious and time-consuming assembly efforts. Furthermore, through the molding process, dimensional tolerances can be tightly controlled, leading to improved reliability and performance. For example, the torque required to turn the adjustment knob 37 should be very consistent among multiple ratchet mechanisms 30 manufactured and assembled in accordance with the present invention. Finally, there is no way for the adjustment knob 37 to become disengaged from the pinion portion 38 of the rotational element 36 absent catastrophic failure of the rotational element 36.

Furthermore, as described in U.S. patent application Ser. No. 10/899,467, the arc-shaped housing sections 32, 24 in this exemplary embodiment have an inherent flexibility that provides for better fit of the headband and increased comfort to the wearer, although such flexibility is immaterial to the unitary nature of the rotational element 36 described above.

Referring again to FIG. 6, the outer housing section 32 of a ratchet mechanism 30 made in this exemplary embodiment is substantially segmented into multiple discrete portions such that the outer housing section 32 is flexible along defined boundaries between the discrete portions. Specifically, in this exemplary embodiment, the outer housing section 32 has a broad wall surface 50 with a height that is slightly greater than the width of the rear end portions 13*e*, 13*f* of the headband 13. Shorter walls 52, 54 extend from the upper and lower edges of this broad wall surface 50. In other words, the outer housing section 32 has a substantially C-shaped cross-section. To obtain the desired flexibility, these walls 52, 54 are provided with detents 56 at spaced intervals. Each detent 56 is formed by angled wall portions that meet at a point. Furthermore, it is preferred that these angled wall portions have a thickness that is less than the nominal thickness of the wall 52, 54, creating a weakened area in the walls 52, 54 that causes "collapse" of the walls at the detent 56, creating a precisely located flex point. Then, by connecting each corresponding pair of detents 56 in the upper and lower walls 52, 54 of the outer housing section 32 with a channel or groove 58 in the broad wall surface 50, defined boundaries are created, and the outer housing section 32 is substantially segmented into multiple discrete portions. Thus, the outer housing section 32 is flexible along the defined boundaries between the discrete portions.

Figure 7:
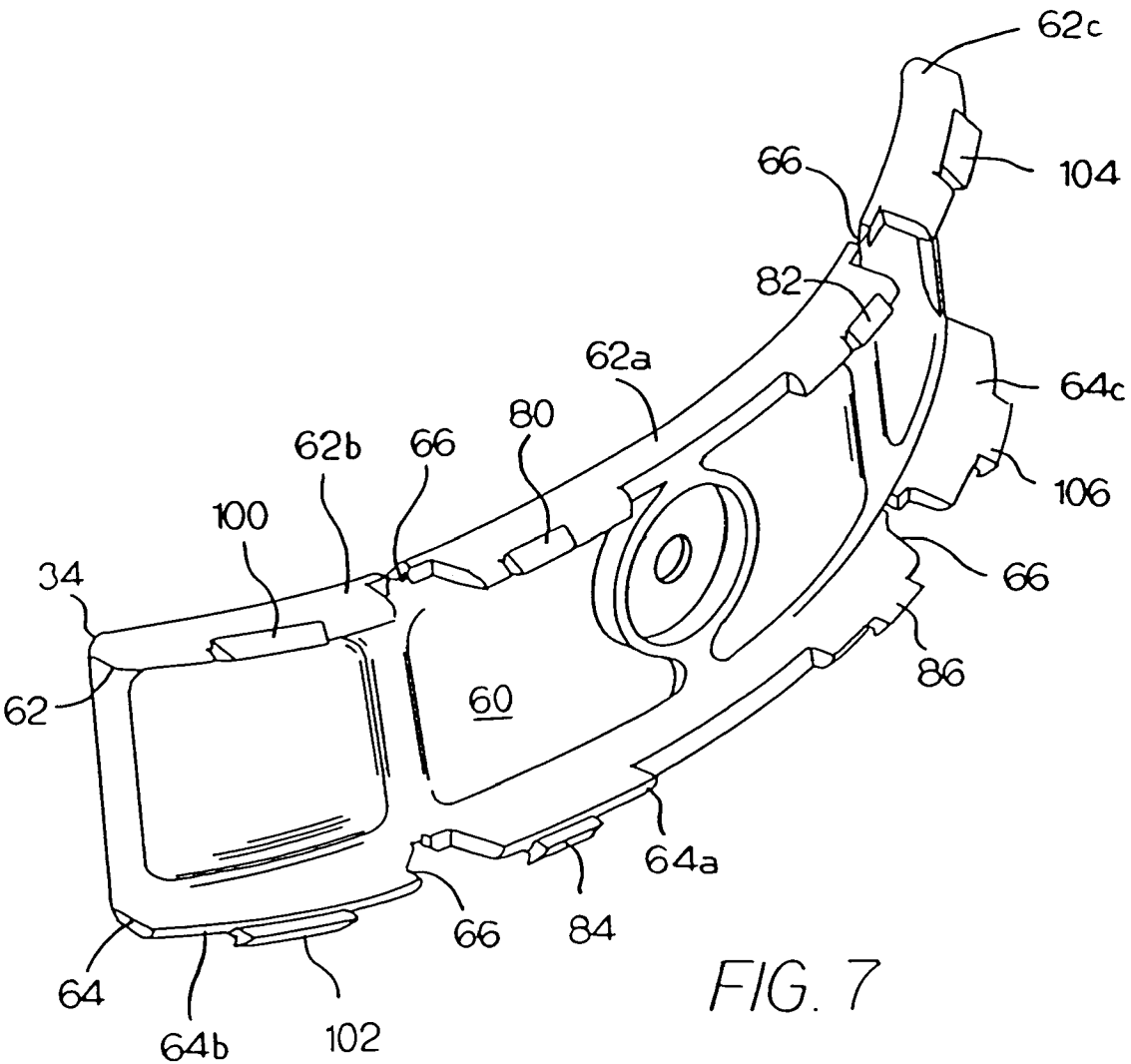
FIG. 7 is a perspective view of the inner housing section of the exemplary ratchet mechanism of FIG. 1 taken along line 7—7 of FIG. 3.

Referring now to FIG. 7, the inner housing section 34 of the ratchet mechanism 30 in this exemplary embodiment is also substantially segmented into multiple discrete portions such that it is flexible along defined boundaries between the discrete portions. Similar to the outer housing section 32, the inner housing section 34 has a broad wall surface 60 with shorter walls 62, 64 that extend from the upper and lower edges of this broad wall surface 60. These upper and lower walls 62, 64 are designed to mate with the corresponding upper and lower walls 50, 52 of the outer housing section 32 to join the two housing sections 32, 34 together, as is further described below. However, rather than be provided with detents, these walls 62, 64 are broken at spaced intervals that correspond with the position of the detents 56 defined in the upper and lower walls 52, 54 of the outer housing section 32. Furthermore, notches 66 are defined in the broad wall surface 60, again to correspond with the position of the detents 56 defined in the upper and lower walls 52, 54 of the outer housing section 32. By connecting each corresponding pair of notches 66 with a channel or groove 68 (as shown in FIG. 2) in the broad wall surface 60, defined boundaries are created, substantially segmenting the inner housing section 34 into multiple discrete portions.

To join the outer housing section 32 and the inner housing section 34, various techniques could be used with departing from the spirit and scope of the present invention. In this exemplary embodiment, the outer and inner housing sections 32, 34 are fastened together in a snap-fit relationship with the shorter walls 62, 64 of the inner housing section 34 fitting inside of and adjacent to the shorter walls 52, 54 of the outer housing section 32. Specifically, referring still to FIG. 7, the center wall segments 62*a*, 64*a* of the inner housing section 34 each include a pair of integral projecting tabs 80, 82, 84, 86, with each such tab extending from a respective wall segment 62*a*, 64*a* in a substantially parallel relationship to the broad wall surface 60. Referring again to FIG. 6, the outer housing section 32 is provided with mating openings 90, 92, 94, 96. As such, when the housing sections 32, 34 are pressed together, the projecting tabs 80, 82, 84, 86 of the inner housing section 34 are received and retained by the mating openings 90, 92, 94, 96 of the outer housing section 32, as generally illustrated in FIGS. 4 and 5, and as will be described in further detail below with reference to FIGS. 8–10.

Furthermore, in this exemplary embodiment, each of the outside wall segments 62*b*, 62*c*, 64*b*, 64*c* of the inner housing section 34 are fastened to the corresponding portions of the walls 52, 54 of the outer housing section 32 using a snap-fit relationship. Specifically, referring again to FIG. 7, the outside wall segments 62*b*, 62*c*, 64*b*, 64*c* each include an integral projecting tab 100, 102, 104, 106, with each such tab extending in a substantially parallel relationship to the broad wall surface 60. Referring again to FIG. 6, the outer housing section 32 is provided with mating openings 110, 112, 114, 116. As such, when the housing sections 32, 34 are pressed together, the projecting tabs 100, 102, 104, 106 of the inner housing section 34 are received and retained by the mating openings 110, 112, 114, 116 of the outer housing section 32, as generally illustrated in FIGS. 4 and 5. Unlike the openings 90, 92, 94, 96 defined through the center portion of the outer housing section 32, however, the outer openings 110, 112, 114, 116 each has a width that is larger than that of the corresponding tab 100, 102, 104, 106.

As such, each tab 100, 102, 104, 106 can "ride" or move within the corresponding openings 110, 112, 114, 116. As such, when the ratchet mechanism 30 is flexed along the defined boundaries, the openings 110, 112, 114, 116 allow for some limited movement of the outside segments of the outer and inner housing sections 32, 34 relative to one another, thus compensating for any shearing motion between the outer and inner housing sections 32, 34 when the housing is flexed.

Figure 8:
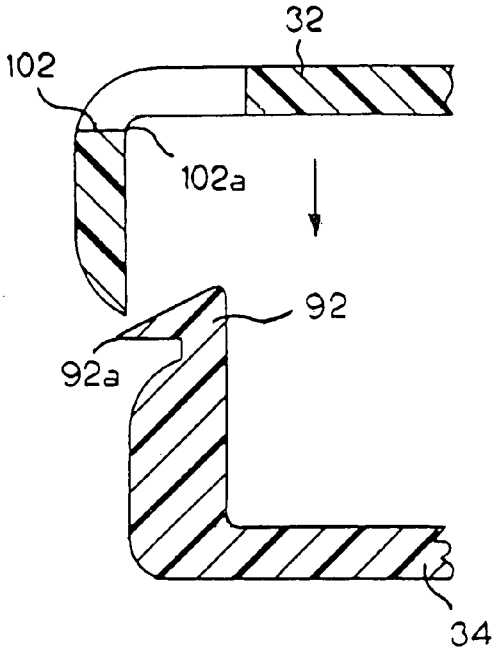
FIGS. 8–10 are sectional views of the inner and outer housing sections of the exemplary ratchet mechanism of FIG. 1, illustrating how the respective housing sections are joined to one another.
Figure 9:
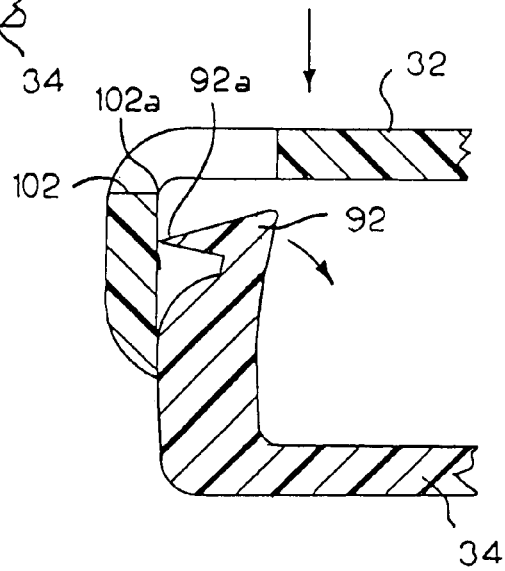
Figure 10:
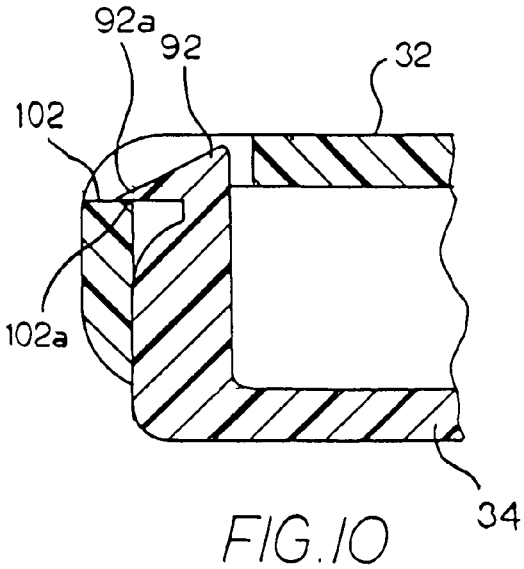

To further explain the snap-fit relationships described above, FIGS. 8–10 are sectional views that illustrate how one projecting tab 92 of the inner housing section 34 is received and retained by an opening 102 of the outer housing section 32. As illustrated in FIGS. 8-10, as the outer section 32 is pressed against the inner housing section 34, the triangular shape of the projecting tab 92 causes it to flex and rotate inwardly. This continues until the tip 92*a* of the tab 92 clears the lip 102*a* of the opening 102. Then, the projecting tab 92 returns to its original, upright position with the tip 92*a* of the tab 92 engaging the lip 102*a* of the opening 102. Each of the other projecting tabs has a similar construction, creating the snap-fit relationship that joins the inner housing section 34 to the outer housing section 32.

Figures 11A, 11B, 12A, 12B:
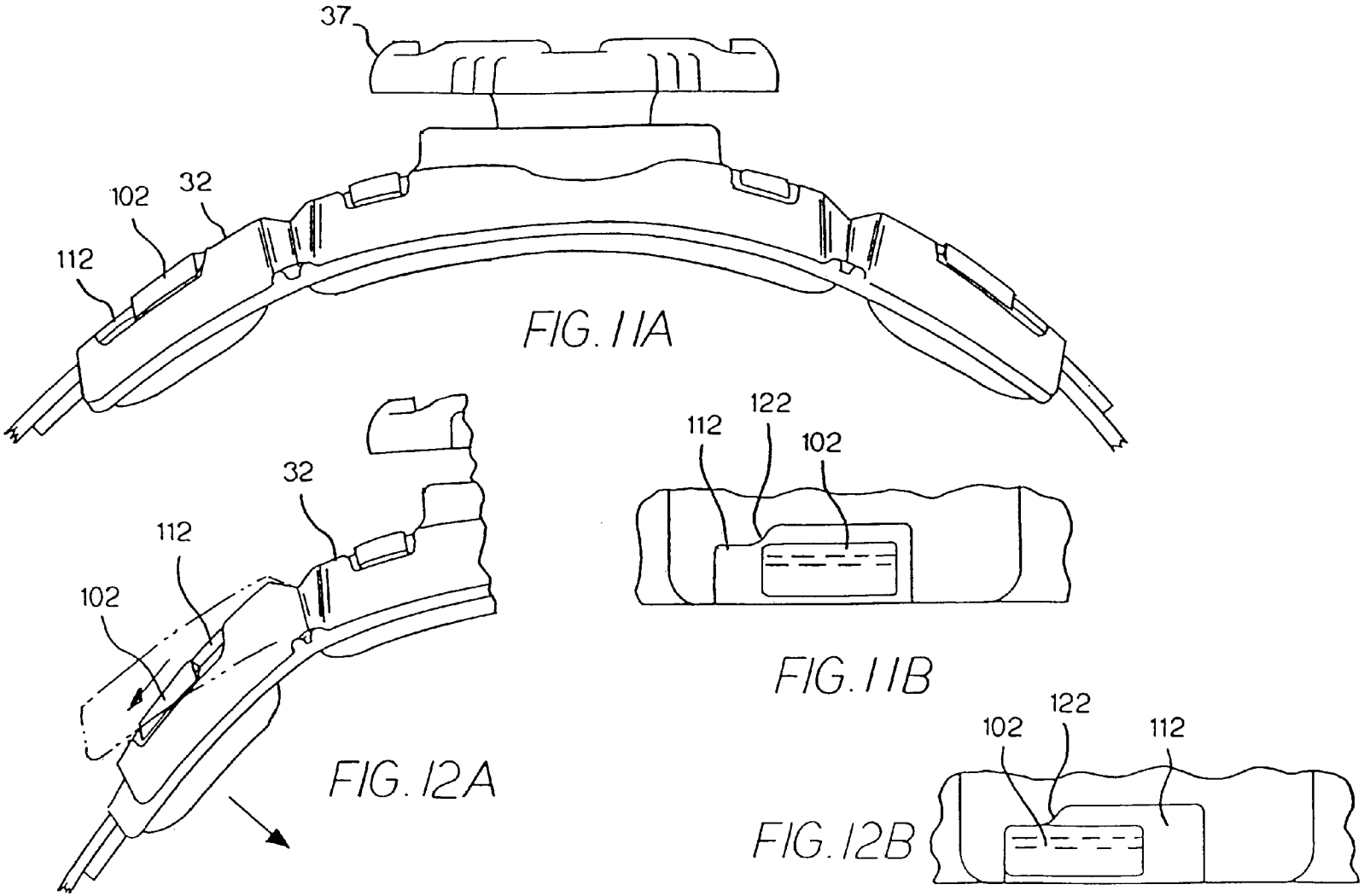
FIG. 11A is a partial side view of the exemplary ratchet mechanism of FIG. 1, illustrating the relationship between an outer tab and a retaining bump when the exemplary ratchet mechanism is in a resting position.
FIG. 11B is a detailed view of the relationship between the outer tab and the retaining bump when the exemplary ratchet mechanism is in the resting position illustrated in FIG. 11A.
FIG. 12A is a partial side view of the exemplary ratchet mechanism of FIG. 1, illustrating the relationship between an outer tab and a retaining bump when the exemplary ratchet mechanism is in a flexed position.
FIG. 12B is a detailed view of the relationship between the outer tab and the retaining bump when the exemplary ratchet mechanism is in the flexed position illustrated in FIG. 12A.

Finally, as described above, when the ratchet mechanism 30 is flexed inwardly along the defined boundaries, each outer tab 100, 102, 104, 106 will "ride" along the corresponding opening 110, 112, 114, 116 until it reaches the end of that opening 110, 112, 114, 116. The position of the tabs 100, 102, 104, 106 in relation to the openings 110, 112, 114, 116 at this point defines a yield point for the snap-fit function. If the ratchet mechanism 30 is flexed beyond this yield point, the natural reaction is for the tabs 100, 102, 104, 106 to begin to move away from and disengage the lips of the respective openings 110, 112, 114, 116, thus reversing the snap-fit motion illustrated in FIGS. 8–10. In short, the snap-fit would fail. Therefore, as a further refinement to control and prevent failure, each of the openings 110, 112, 114, 116 in this exemplary embodiment includes a retaining bump. On such retaining bump 122 is illustrated in FIGS. 11A, 11B, 12A, and 12B. When the ratchet mechanism 30 is flexed inwardly toward the yield point, the tab 102 will move between the retaining bump 122 and the edge of the opening 112, as illustrated in FIGS. 12A and 12B. If the housing is flexed beyond the yield point, the retaining bump 122 will retain the tab 102 in a locked position relative to the opening 112. In this regard, it should be recognized that the natural or resting position of the ratchet mechanism 30, as illustrated in FIGS. 11A and 11B, is the suggested position when the ratchet mechanism 30 is assembled. This position allows each outer tab 102 adequate clearance from the retaining bump 122, so that the tab 102 can momentarily flex and then "snap" or lock onto the opening 112 as described above with reference to FIGS. 8–10.

Again, although the exemplary embodiment described above includes arc-shaped housing sections 32, 24 that have an inherent flexibility, such flexibility is immaterial to the unitary nature of the rotational element 36 described above.

Thus, the ratchet mechanism 30 of the present invention allows for adjustment of the size and fit of the protective helmet 10 or other headgear, and because of the unitary knob and pinion construction, the number of components is minimized, while a precise, reliable operation of the rack and pinion arrangement is ensured. Furthermore, as mentioned above, although the exemplary ratchet mechanism described herein is incorporated into a hard hat, the ratchet mechanism of the present invention can certainly be incorporated into other types of headgear that have an adjustable headband, such as faceshields and respirator hoods, without departing from the spirit and scope of the present invention.

It will be obvious to those skilled in the art that further modifications may be made to the embodiments described herein without departing from the spirit and scope of the present invention.

What is claimed is:

1. A ratchet mechanism for a headband that has overlapping rear end portions, each such portion defining an elongated slot and associated rack gear, comprising:

a housing, including an outer housing section joined to an inner housing section, thus defining an internal cavity for receiving the overlapping rear end portions of said headband; and a rotational element that has a one piece construction, including a pinion portion which is adapted to mate with and engage the respective rack gears of the overlapping rear end portions of said headband, and an adjustment knob portion extending from said housing and adapted to be grasped and rotated by a wearer to cause lateral movement of the overlapping rear end portions of said headband with respect to one another;

wherein the outer housing section defines an opening therethrough, the rotational element being molded through said opening with the adjustment knob portion and the pinion portion positioned on opposite sides of the outer housing section; and wherein, because of the molding of the rotational element through said opening, neither the adjustment knob portion nor the pinion portion can be drawn through said opening, and as such, the rotational element remains engaged with and can not be separated from the outer housing section absent a catastrophic failure of the ratchet mechanism.

2. The ratchet mechanism as recited in claim 1, wherein the outer housing section is substantially segmented into multiple discrete portions such that the outer housing section is flexible along defined boundaries between such discrete portions, and wherein the inner housing section is similarly and substantially segmented into corresponding discrete portions such that the inner housing section is also flexible along defined boundaries between such discrete portions, such that, when the outer and inner housing sections we joined, the housing of the ratchet mechanism has a flexibility that allows it to conform to the head shape of a wearer.

3. The ratchet mechanism as recited in claim 1, wherein the outer housing section is first formed in a mold cavity, and then the rotational element is molded and formed around the outer housing section in said mold cavity.

4. The ratchet mechanism as recited in claim 1, wherein a first plastic is used to form the outer housing section, and a second, dissimilar plastic is used to form the rotational element.

5. The ratchet mechanism as recited in claim 1, wherein the rotational element further includes an integral spring assembly comprised of two substantially semi-circular arch portions, with a spring toot extending from each of said arch portions and adapted to engage the teeth of a ring gear defined by the outer housing section, thus locking the position of the rotational element unless a wearer imparts a sufficient torque on the adjustment knob portion of the rotational element.

6. The ratchet mechanism as recited in claim 1, wherein the rotational element further includes an integral shaft portion passing through the opening defined through said outer housing section and joining the adjustment knob portion, which is positioned on an exterior side of the outer housing section, to the pinion portion, which is positioned on an interior side of the outer housing section.

7. A ratchet mechanism for a headband that has overlapping rear end portions, each such portion defining an elongated slot and associated rack gear, comprising:

a housing defining an internal cavity for receiving the overlapping rear end portions of said headband; and a rotational element that has a one piece construction, said rotational element including a pinion portion adapted to mate with and engage the respective rack gears of the overlapping rear end portions of said headband, and an adjustment knob portion adapted to be grasped and rotated by a wearer to cause lateral movement of the overlapping rear end portions of said headband with respect to one another;

wherein the rotational element is molded around the housing and through an opening defined by said housing, with the pinion portion positioned within the internal cavity defined by said housing and the adjustment knob portion positioned on an exterior side of the housing; and wherein, because of the molding of the rotational element round the housing and through the opening defined by said housing, neither the adjustment knob portion nor the pinion portion can be drawn through said opening, and as such, the rotational element remains engaged with and can not be separated from the housing absent a catastrophic failure of the ratchet mechanism.

8. The ratchet mechanism as recited in claim 7, wherein the rotational element further includes an integral shaft portion which joins the adjustment knob portion to the pinion portion said shaft portion passing through the opening defined through said housing.

9. The ratchet mechanism as recited in claim 7, wherein the rotational element further includes an integral spring assembly comprised of two substantially semi-circular arch portions, with a spring tooth extending from each of said arch portions and adapted to engage the teeth of a ring gear associated with the housing, thus locking the position of the rotational element unless a wearer imparts a sufficient torque on the adjustment knob portion of the rotational element.

10. In a ratchet mechanism for a headband that has overlapping rear end portions, each such portion defining an elongated slot and associated rack gear and being enclosed in a housing, the improvement comprising:

a rotational element molded around the housing and through an opening defined by said housing and having a one piece construction, said rotational element including a pinion portion adapted to mate with and engage the respective rack gears of the overlapping rear end portions of said headband, and an adjustment knob portion extending from said housing and adapted to be grasped and rotated by a wearer to cause lateral movement of the overlapping rear end portions of said headband with respect to one another;

wherein, because of the molding of the rotational element around the housing and through the opening defined by said housing, neither the adjustment knob portion nor the pinion portion can be drawn through said opening, and as such, the rotational element remains engaged with and can not be separated from the housing absent a catastrophic failure of the ratchet mechanism.

* * * * *

UNITED STATES PATENT AND TRADEMARK OFFICE

CERTIFICATE OF CORRECTION

PATENT NO. : 7,043,772 B2
APPLICATION NO. : 10/930633
DATED : May 16, 2006
INVENTOR(S) : Bielefeld et al.

It is certified that error appears in the above-identified patent and that said Letters Patent is hereby corrected as shown below:

IN THE CLAIMS:

Claim 2, col. 10, line 43: Change the word “we” to --are--

Claim 5, col. 10, line 57: Change the word “toot” to --tooth--

Signed and Sealed this

Third Day of April, 2007

JON W. DUDAS
*Director of the United States Patent and Trademark Office*